US007726907B2

(12) United States Patent
McCreedy et al.

(10) Patent No.: US 7,726,907 B2
(45) Date of Patent: Jun. 1, 2010

(54) AUTOMATIC TRIP GATE

(76) Inventors: C. Thomas McCreedy, 1269 Cerranar Ct., Eagle, ID (US) 83616; Dennis Daugherty, P.O. Box 720, Parma, ID (US) 83360

( * ) Notice: Subject to any disclaimer, the term of this patent is extended or adjusted under 35 U.S.C. 154(b) by 360 days.

(21) Appl. No.: 11/836,982

(22) Filed: Aug. 10, 2007

(65) Prior Publication Data

US 2008/0038063 A1 Feb. 14, 2008

Related U.S. Application Data

(60) Provisional application No. 60/821,990, filed on Aug. 10, 2006.

(51) Int. Cl.
*E02B 7/40* (2006.01)

(52) U.S. Cl. ..... 405/101; 405/94; 210/170.01

(58) Field of Classification Search ..... 405/92, 405/93, 99–101; 210/7, 153, 170.01, 170.03
See application file for complete search history.

(56) References Cited

U.S. PATENT DOCUMENTS

| | | | | | |
|---|---|---|---|---|---|
| 3,630,034 | A | | 12/1971 | Whitlock | 61/12 |
| 3,910,052 | A | | 10/1975 | Whitlock | 61/12 |
| 3,942,328 | A | | 3/1976 | Bunger | 61/25 |
| 3,953,978 | A | | 5/1976 | Soileau | 61/28 |
| 4,073,147 | A | * | 2/1978 | Nomura | 405/94 |
| 4,103,497 | A | * | 8/1978 | Colamussi et al. | 405/96 |
| 4,455,231 | A | | 6/1984 | Filippi | 210/519 |
| 4,467,645 | A | | 8/1984 | Murphree | 73/215 |
| 4,505,612 | A | * | 3/1985 | Shelley, Jr. | 405/101 |
| 4,549,837 | A | | 10/1985 | Hebert | 405/101 |
| 4,657,434 | A | * | 4/1987 | Woolnough | 405/81 |
| 4,728,221 | A | | 3/1988 | Tsuji et al. | 405/115 |
| 4,800,917 | A | | 1/1989 | DePirro | 137/315 |
| 5,171,102 | A | | 12/1992 | De Wit | 405/101 |
| 5,577,863 | A | | 11/1996 | Nottle | 405/87 |
| 5,595,457 | A | | 1/1997 | Stucks | 405/87 |
| 5,967,697 | A | | 10/1999 | Larsen | 405/104 |
| 5,984,575 | A | | 11/1999 | Knott, Sr. | 405/92 |
| 6,427,718 | B1 | | 8/2002 | Stringam et al. | 137/392 |
| 6,623,209 | B1 | | 9/2003 | Waters, Jr. | 405/94 |
| 6,692,187 | B2 | | 2/2004 | Sprengle, Sr. et al. | 405/92 |
| 6,860,289 | B2 | | 3/2005 | Villwock et al. | 137/592 |
| 6,997,644 | B2 | | 2/2006 | Fleeger | 405/96 |

* cited by examiner

*Primary Examiner*—Tara Mayo-Pinnock
(74) *Attorney, Agent, or Firm*—Holland Law Office, PLLC

(57) ABSTRACT

An automatic trip gate for installation in a gate support structure at a bank of an impounded body of water. The automatic trip gate controls a release of an overflow of water through the gate support structure upon the occurrence of an overflow event. The automatic trip gate includes a plate supported by a hinge assembly that attaches to the support structure. A trough attached to the plate catches and retains overflow water. When the level of overflow water in the trough reaches a tipping level, the plate pivots from a substantially vertical orientation wherein the impounded body of water is maintained behind the plate, to a tipped position wherein the impounded body of water is released o through the gate support. A plunge pool is located below the automatic trip gate that absorbs the energy imparted by the plate when tripped.

20 Claims, 10 Drawing Sheets

AUTOMATIC TRIP GATE

RELATED APPLICATIONS

This application claims the priority of Provisional Application Ser. No. 60/821,990 entitled Spillway Weir Gate, filed Aug. 10, 2006, the content of said application being incorporated herein by reference.

BACKGROUND OF THE INVENTION

A device for diverting flow from a canal drop, small earthen dam or branch to an emergency spillway should a primary diversion fail unexpectedly was required at a small hydroelectric project being developed by the inventors. Several commercial products were available, such as the Obermeir Hydro, Inc. Pneumatically Operated Spillway Gate. This gate consists of a hinged plate held in place by an air bladder. In order to operate, this product includes a control valve, which could fail to operate. In the interest of providing a gate with no controls, a simple, economical alternative was required.

SUMMARY OF THE INVENTION

The present invention is directed to a device and method for directing or diverting a flow of water from a first water channel to an emergency spillway in the case of a spillover or other control event wherein water from a first water channel overflows. An automatic trip gate is installed in a gate support structure at a bank of an impounded body of water. The automatic trip gate controls a release of an overflow of water through the gate support structure upon the occurrence of an overflow event. The automatic trip gate includes a plate supported by a hinge assembly that attaches to the support structure. A trough attached to the plate catches and retains overflow water. When the level of overflow water in the trough reaches a tipping level, the plate pivots from a substantially vertical orientation wherein the impounded body of water is maintained behind the plate, to a tipped position wherein the impounded body of water is released through the gate support. In a preferred embodiment of the invention, a plunge pool is located below the automatic trip gate that absorbs the energy imparted by the plate when tripped.

In one embodiment, the automatic trip gate is installed or constructed in feed canal at a hydroelectric plant. The flow and head for the plant was developed at an intersection of two earthen irrigation canals. The plant took flow from a branch that dropped 38 feet from the upper canal to a lower canal. Flow normally passes through the plant turbines. When the plant is shutdown, flow is bypassed through an existing flume by opening two small radial gates via an automated control system. In the event that the bypass failed the canal would be over topped, and possibly wash out. In the described embodiment and installation, a separate spillway fitted with multiple automatic trip gates provided the solution to this concern.

The automatic trip gate and spillway of the present invention may be used at any impoundment, dam or canal where overtopping could cause failure of the structure due to erosion. In many cases, a lowered section in the dam acts as an emergency spillway and discharges into some form of channel. This, however, reduces head or storage behind the dam. With the automatic trip gate, the operating level can be higher, near the top of the gate, which will tip over and discharge into a channel when water level exceeds a set point.

DETAILED DESCRIPTION

Figure 1:
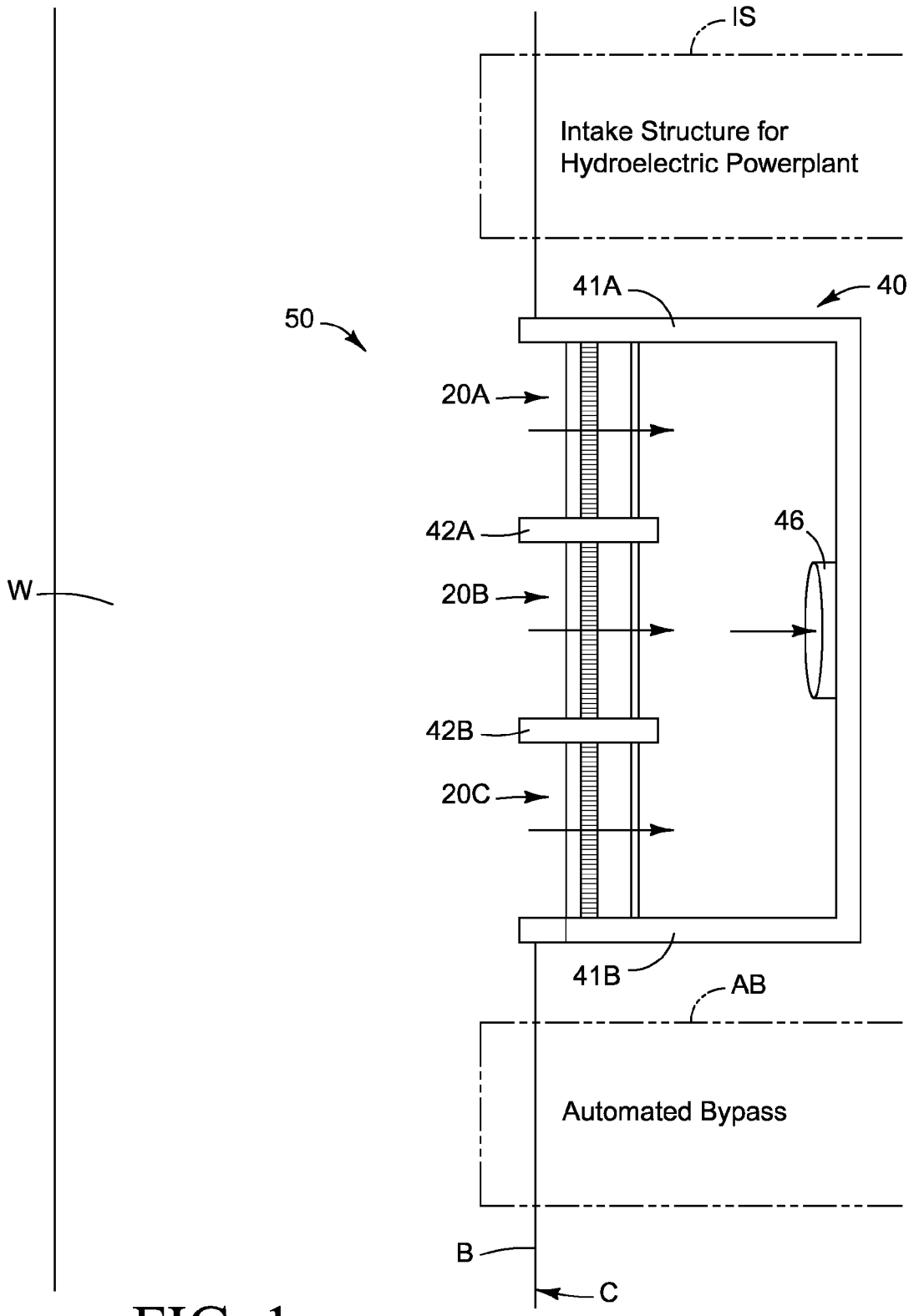
FIG. 1 is an overhead plan view of an automatic trip gate system according to the present invention.

FIG. 1 a typical installation of automatic trip gate system 50 including in this installation three separate automatic trip gates 20A, 20B and 20C. In the instance represented in FIG. 1, automatic trip gate system 50 is installed at a location on canal C, where a low head hydroelectric plant, (not shown), has been established. Intake structure IS provides a flow of water to the hydro-electric plant during generation. When the hydroelectric plant experiences an unexpected shut down, overflow of canal water is handled by automated bypass AB, which is controlled in conjunction with the control of operation of the hydroelectric plant such that while water is flowing through the intake structure IS to the turbine, (not shown), located in the hydroelectric plant, a controlled valve, (not shown), of the automated bypass AB is closed so that flow is diverted through the intake structure IS. When the hydroelectric plant is out of service or operation, the controlled valve of the automated bypass AB is opened so that flow is diverted to a stilling basin or canal, (not shown).

In the event that the hydro-electric plant experiences an unexpected shut down, i.e. no water flow is being diverted through the turbine, and the controlled valve of the automated bypass AB is inoperative and fails to open for any of a number of reasons, flow, in an overtopping situation, will be diverted by operation of the automatic trip gate system 50 to a stilling basin or canal through outlet pipe 46.

Figure 2:
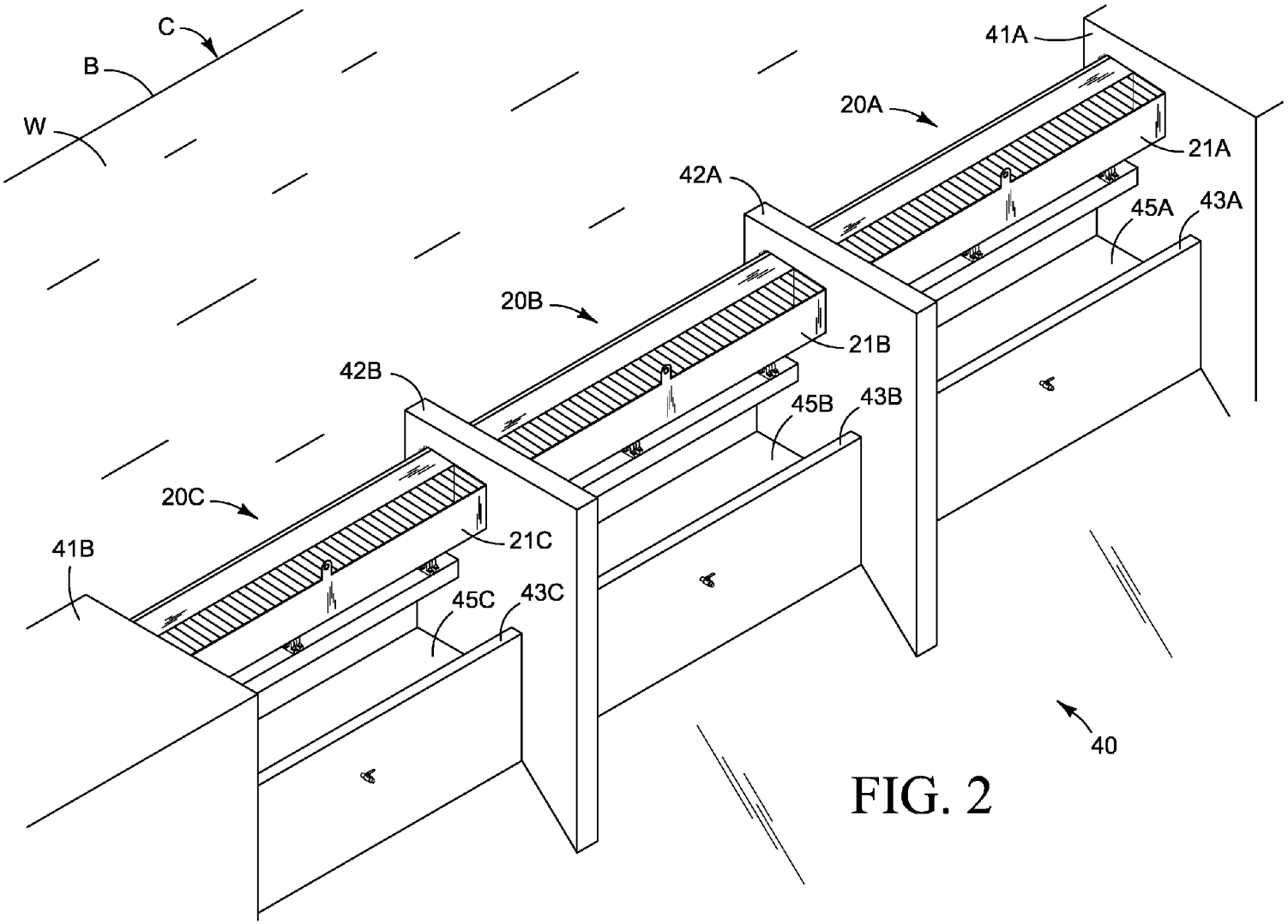
FIG. 2 is an isometric view of an automatic trip gate system according to the present invention.
Figure 3:
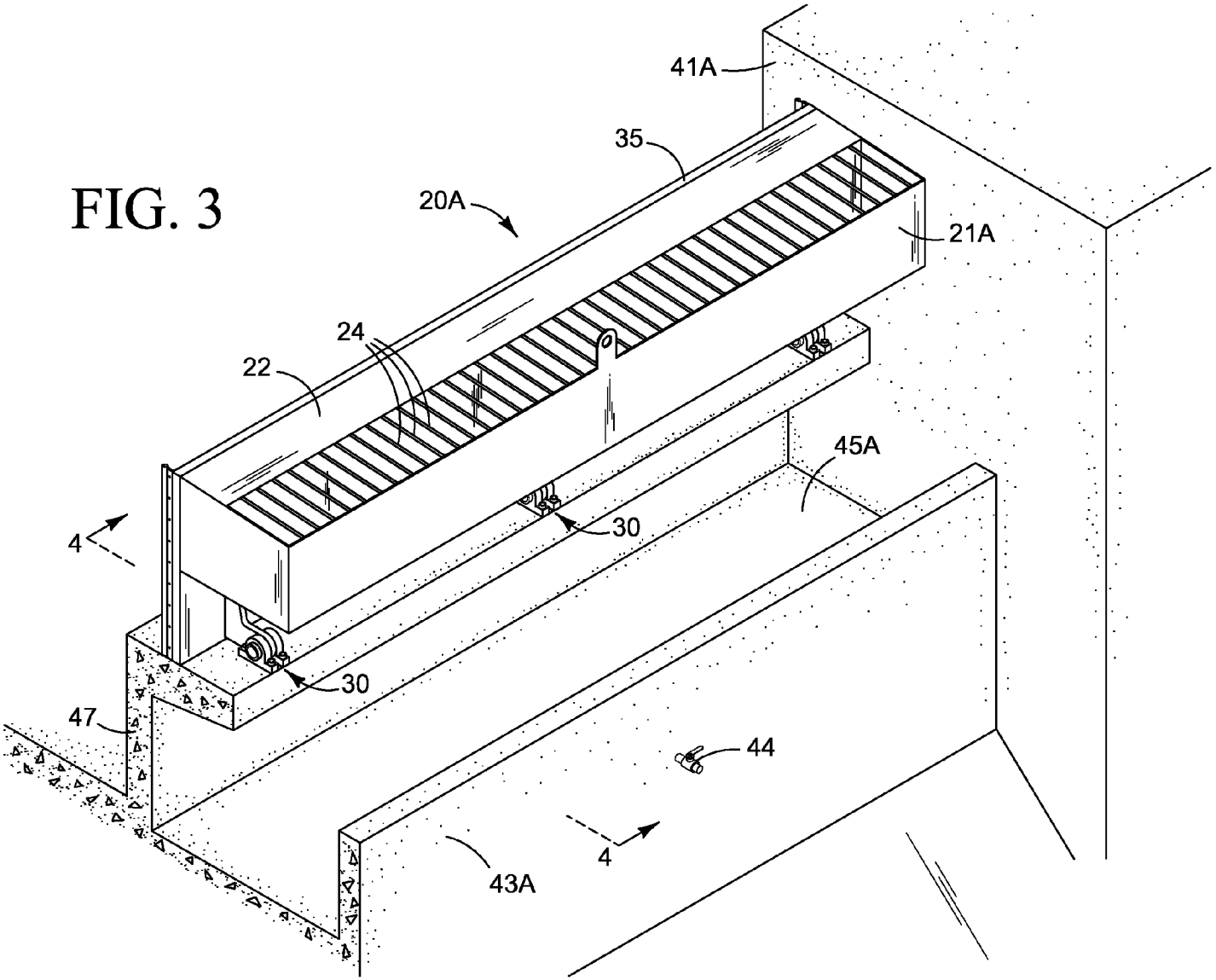
FIG. 3 is an isometric view of an automatic trip gate according to the present invention.

FIGS. 1 and 2 show automatic trip gate system 50 is installed in a trip gate support structure, in this case spillway 40 which is constructed at a bank B of an impoundment of water W, in this case canal C. Each of the three separate automatic trip gates 20A, 20B and 20C are installed between support structures of the spillway 40. Automatic trip gate 20A is installed between spillway sidewall 41A and first pier 42A. Similarly, automatic trip gate 20B is installed between first and second piers 42A and 42B. Automatic trip gate 20C is installed between spillway sidewall 41B and second pier 42B.

As shown in FIG. 2, each of the automatic trip gates 20A, 20B and 20C include a trough 21A, 21B and 21C respectively. Spillway 40 is also constructed such that below each of the three separate automatic trip gates 20A, 20B and 20C, a plunge pool is located. Thus plunge pool 45A is formed below automatic trip gate 20A, plunge pool 45B is formed below automatic trip gate 20B and plunge pool 45C is formed below automatic trip gate 20C. Each plunge pool 45A, 45B and 45C is formed behind a retaining wall 43A, 43B and 43C respectively.

Referring to FIGS. 3, 4, 5 and 6 automatic trip gate 20A is shown supported by gate support structure 47 and installed against spillway sidewall 41A. Plunge pool 45A is shown formed below automatic trip gate 20A and behind retaining wall 43A. Automatic trip gate 20A is shown including trough 21A attached to plate 35 by gate top plate 22. The top of the trough 21A is covered by trash screen 27 which prevents trash and other debris from filling trough 21A. Automatic trip gate 20A is pivotably supported by hinged support arm assembly 30. Hinged support arm assembly 30 is typical of the plurality of hinged support arm assemblies that pivotably support trough 21A.

Figure 4:
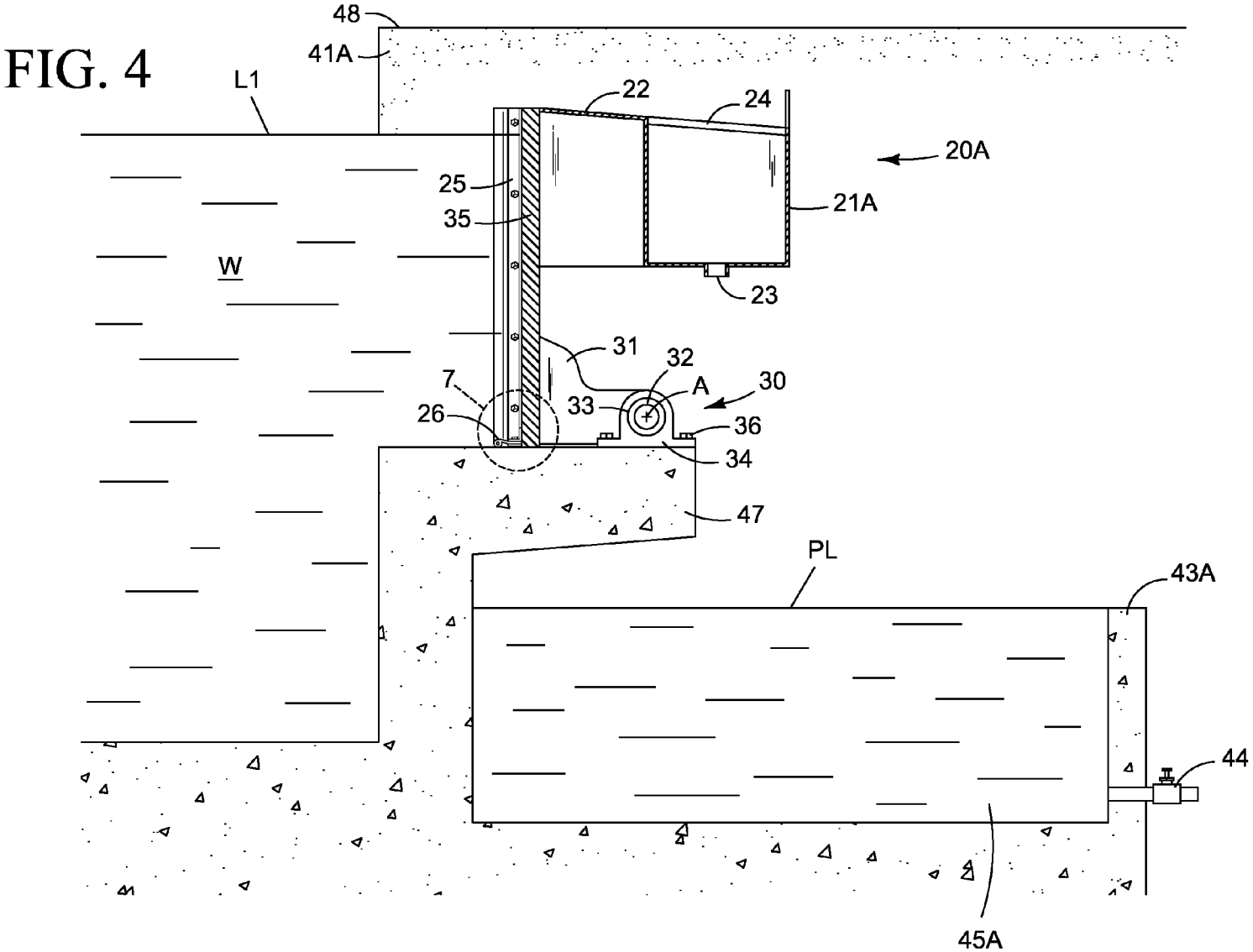
FIG. 4 is a cross section of the automatic trip gate according to the present invention, showing upstream operating water level and the entrance to the spillway.
Figure 5:
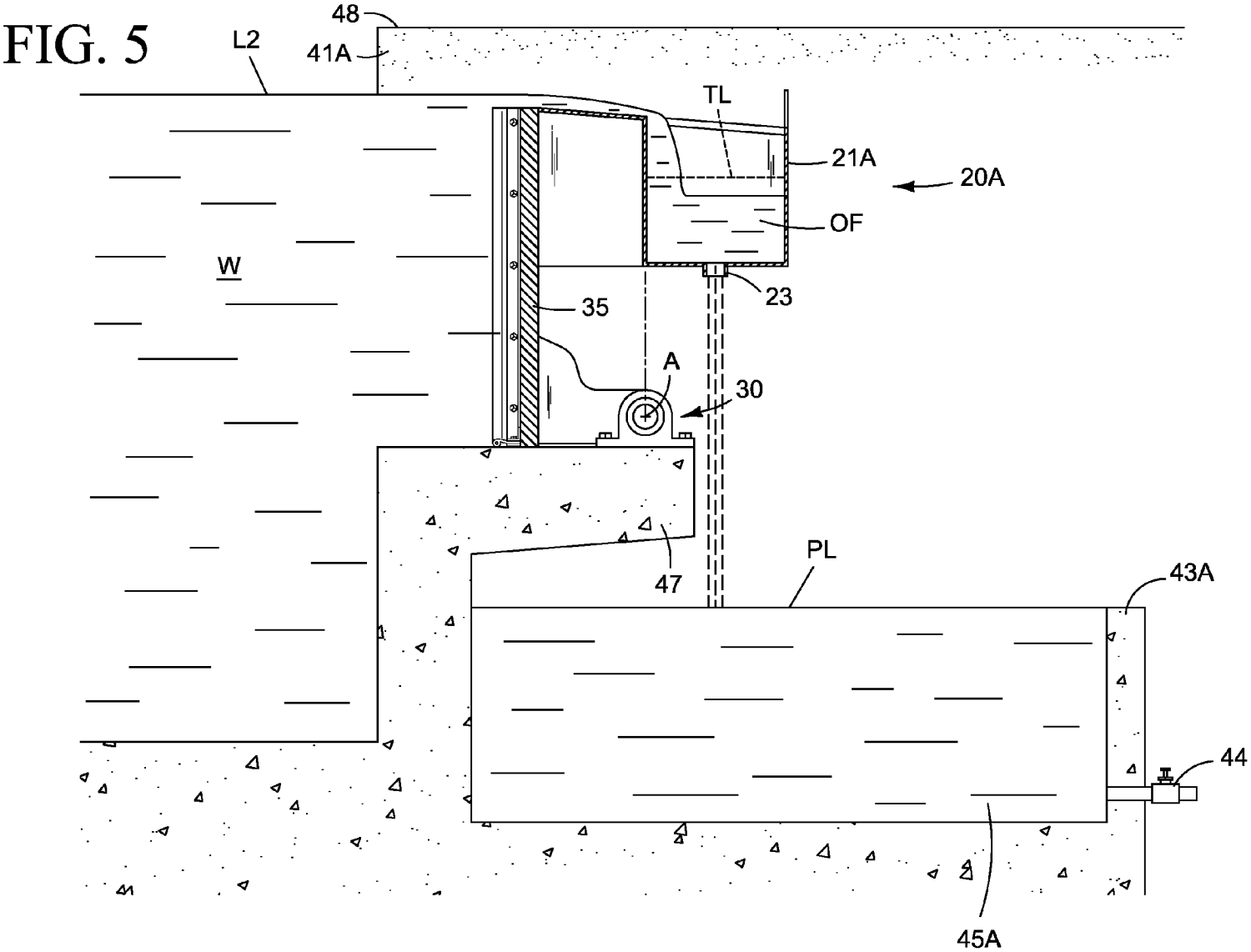
FIG. 5 is a cross section of the automatic trip gate according to the present invention, showing a tripping water level.
Figure 6:
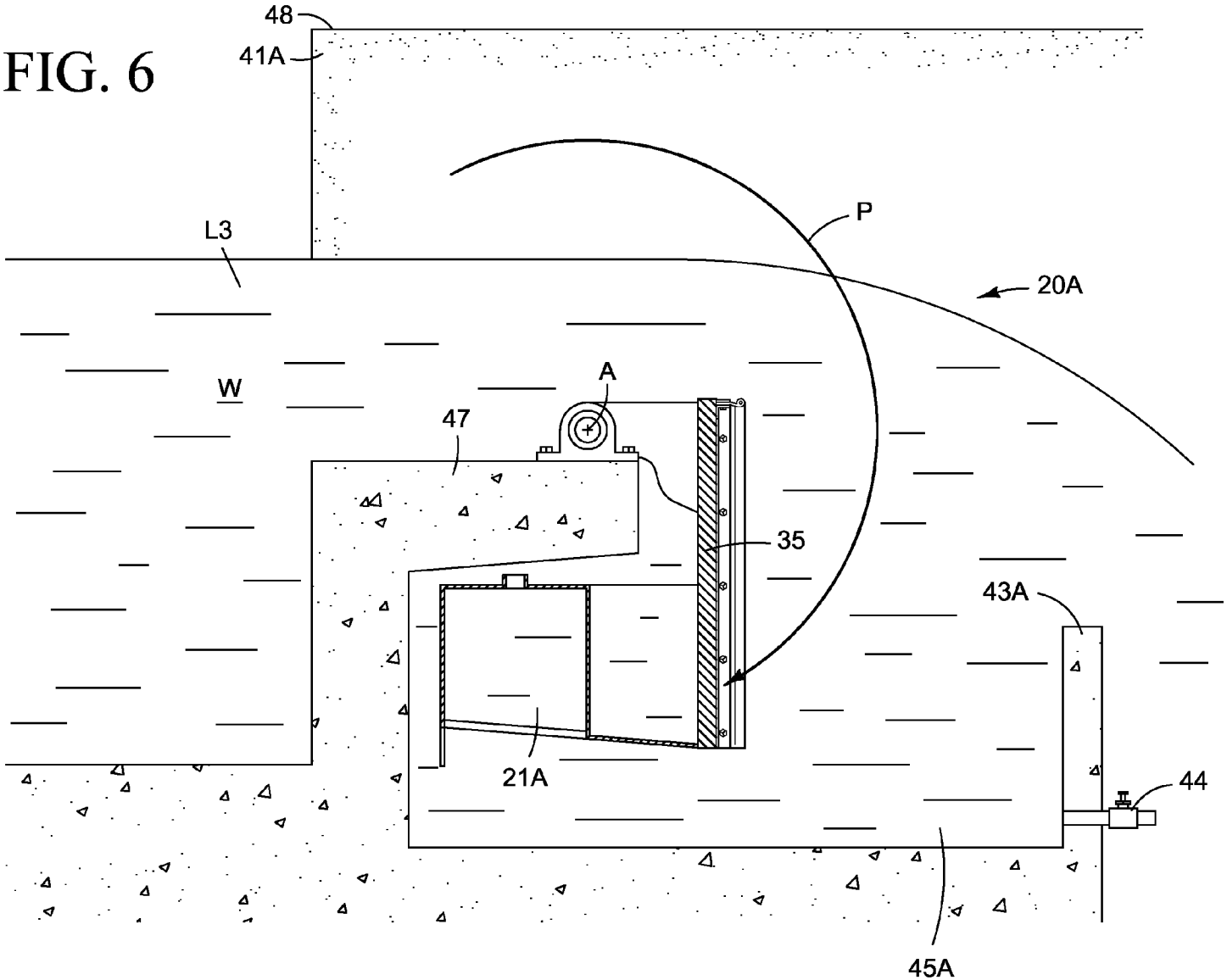
FIG. 6 is a cross section of the automatic trip gate according to the present invention, showing a post tripping water level.

Referring to FIGS. 4, 5 and 6, hinged support arm assembly 30 includes foot 31 that extends between and is connected at one end to plate 35 and at a second end to hinge end support 34 by hinge pin 32. Hinge end support 33 attaches to gate support structure 47 using hardware 36. Hinge pin 32 is supported in hinge end support 34 by bushing 33. In a preferred embodiment, bushing 33 is a nylon, molybdenum impregnated self-lubricating which provides low friction for the overturning action. Also in a preferred embodiment, foot 31 is welded to plate 35.

FIGS. 4, 5 and 6 show automatic trip gate 20A as it goes from standby position wherein water W retained behind automatic trip gate 20A is maintained at a desired operating level L1 as shown in FIG. 4, to tipped position as seen in FIG. 6, wherein automatic trip gate 20A is shown in a tripped position and water W is maintained at a post-trip level L3.

FIG. 5 shows water W behind automatic trip gate 20A has reached an overflow level L2, wherein water W has crested plate 35, and begins to flow over trip gate top plate 22 filling trough 21A. In FIG. 5, trough 21A is shown retaining overflow water OF which, when it reaches a tripping level TL, causes trough 21A and the attached trip gate top plate 22 and plate 35 to pivot at the axis of rotation A of hinge pin 32 along trip path P releasing water W through spillway 40.

Referring to FIGS. 4 and 5 it will be noted that a plunge water level PL is controlled in plunge pool 45A. At a desired operating level L1 some splash will invariably come over the top of plate 35, flowing over trip gate top plate 22 filling trough 21A. Drain hole 23 in trough 21A drains water from trough 21A that has entered by casual wave action or precipitation so that the level of overflow water OF does not reach tripping level TL when an overflow event has not occurred. The speed at which overflow water OF drains from trough 21A, and therefore also the speed at which the level of overflow water OF rises and reaches tripping level TL, can be regulated by the size and number of drain holes 23 incorporated in trough 21A. Troughs 21A, 21B and 21C may be constructed in such a manner that they reach a trip level substantially at the same time or in a sequence.

As the level of water W in canal C rises, more water W begins to come over plate 35 and trip gate top plate 22 filling trough 21A. When the water level in trough 21A reaches tripping level TL, plate 35 and the attached trip gate top plate 22 and trough 21A tip rotating at the axis of rotation A of hinge pin 32 along path P. Plunge water level PL in plunge pool 45A is high enough that the water contained in plunge pool 45A acts to absorb the energy imparted by the plate 35 and the attached trip gate top plate 22 and trough 21A. Plunge water level PL may be filled initially by diverting water from canal C, i.e. through a hose or other conduit, not shown. Alternately plunge water level PL is filled following a tripping of plate 35. Plunge water level PL is maintained by precipitation or minor leakage around the seals. Excess plunge water level PL flows over the top of wall 43A. Plunge pool 45A may be drained by opening drain valve 44.

Flow over the tripped automatic trip gate 20A determines the length and height of automatic trip gate 20A using the formula Q=KLH 3/2, using a K factor of 3.33 for a flat, broad-crested weir. The length of automatic trip gate 20A can be selected first and the height can be calculated using the above formula. The converse is true, the height of automatic trip gate 20A can be selected and the length is then a function of the formula. Referring to FIG. 5, a desired water level L1 is held approximately 7.62 centimeters, (three inches), below the top of plate 35. This level can be selected based on the top of the canal or dam embankment. For example, the top of the embankment 48 can be approximately 22.86 centimeters, (nine inches), above the desired operating level L1 to provide a safety factor for waves or other brief disturbances.

Plate 35 is made of a thick steel plate. Trough 21A and trip gate top plate 22 are made of a thin steel plate. The weight of plate 35 and the length of foot 31 extending between plate 35 and hinge pin 32 provide the moment to resist the opposite hydraulic force from water W. As seen in FIG. 4, trough 21A is located at least partially behind or downstream from an axis of rotation A of hinge pin 32 so that as trough 21A fills, it adds overturning moment.

Figure 7:
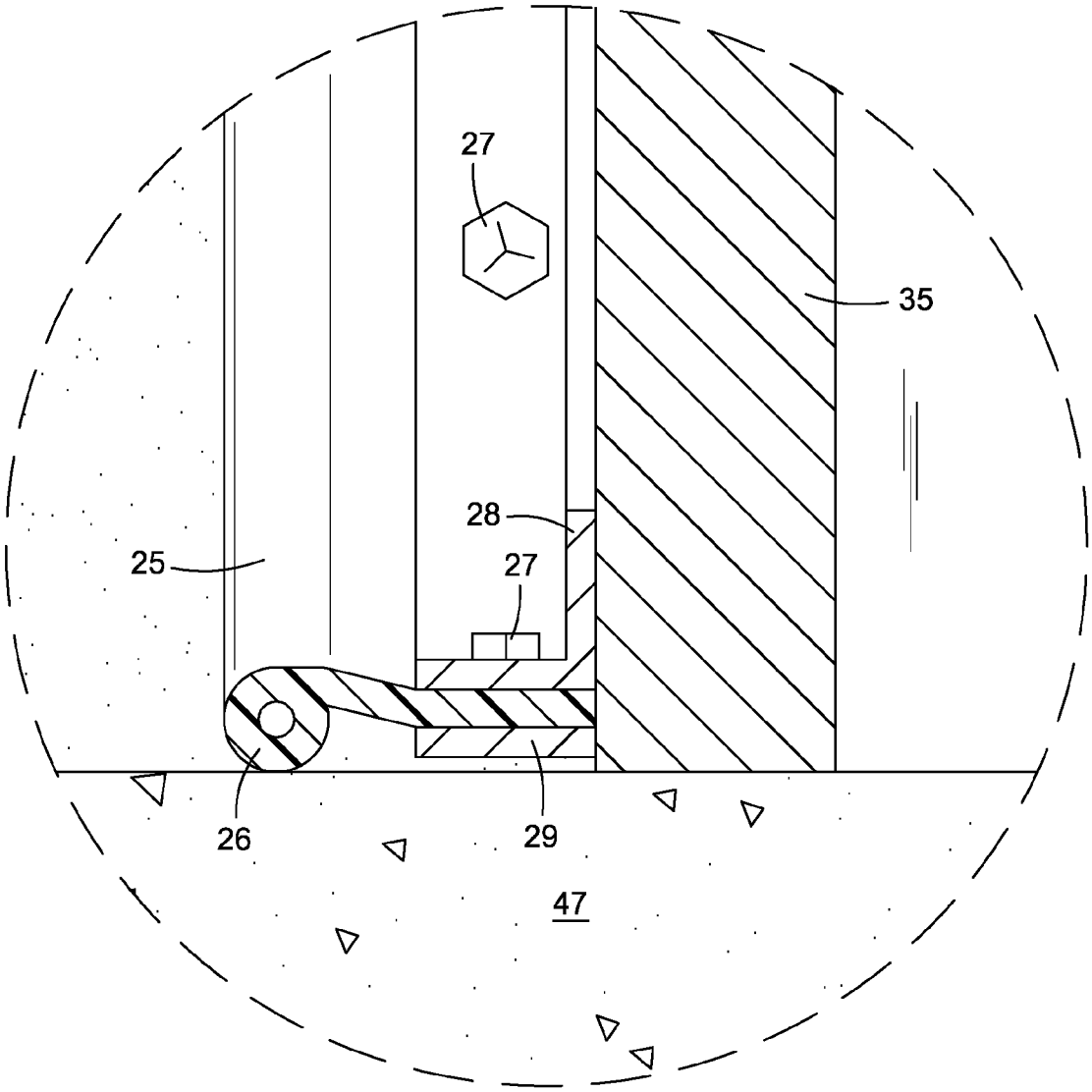
FIG. 7 is a detailed part plan showing a seal for one side of the automatic trip gate.

FIG. 7 shows details of lower gate seal 26 which is of the solid bulb and tail seal type, as manufactured by Seals Unlimited of Beaverton, Oreg. Lower gate seal 26 is held in place by steel support angle 28 and pinch bar 29. A compressive force is maintained between steel support bar 28 and pinch bar 29 by a plurality of screws 27.

Figure 8:
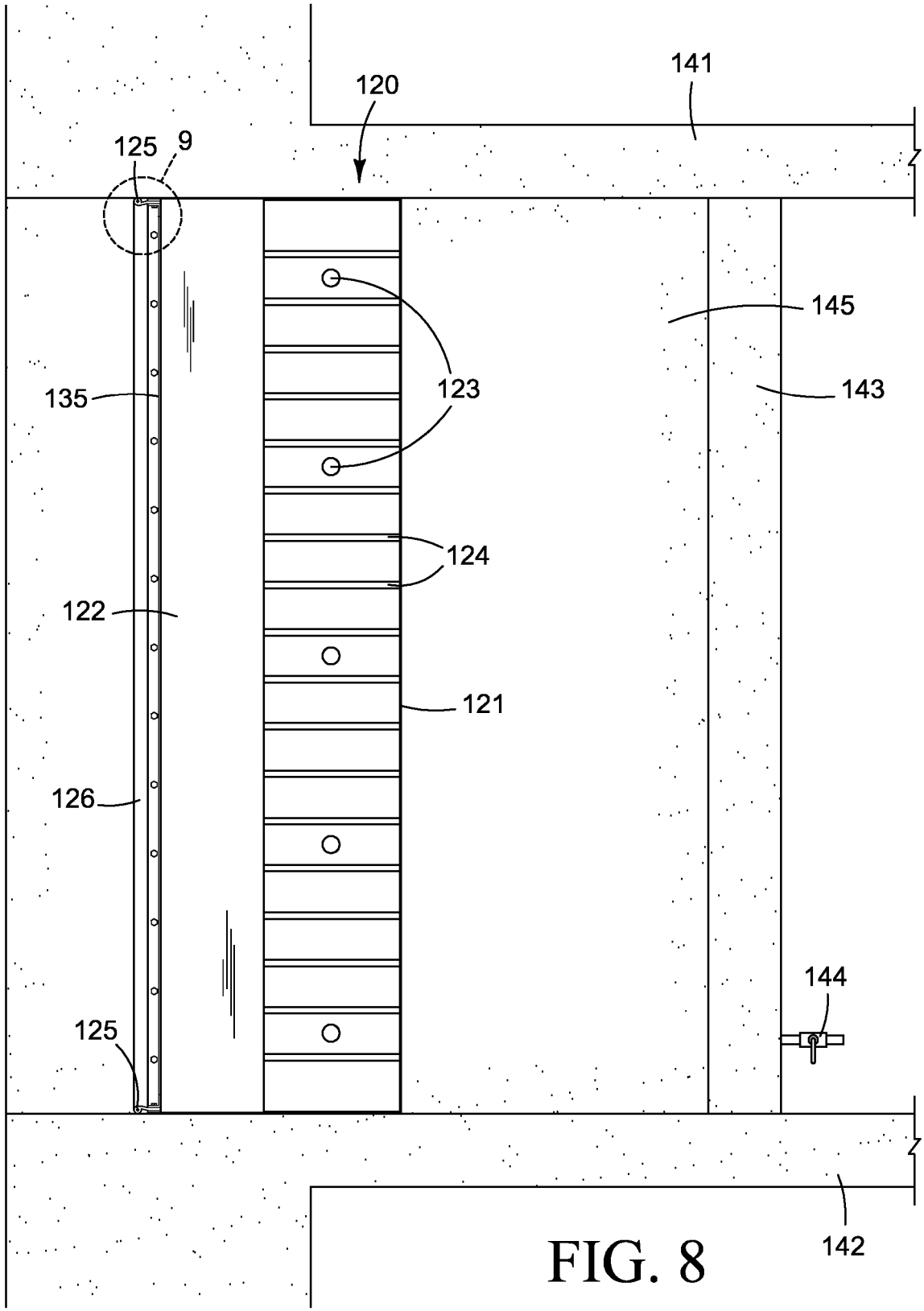
FIG. 8 is an overhead plan view showing an installation of a single automatic trip gate.

FIG. 8 is an overhead plan view showing an installation of a single automatic trip gate 120 installed between side structure 141 and 142 of spillway 140. Automatic trip gate 120 is shown including trough 121 attached to plate 135 by gate top plate 122. The top of trough 121 is covered by trash screen 127 which prevents trash and other debris from filling trough 121. Trough 121 includes a plurality of drain holes 123 which regulate a water level maintained in trough 121. Plunge pool 145 is shown formed below automatic trip gate 120 and behind retaining wall 143. Automatic trip gate 120 is shown including lower gate seal 126 and lateral gate seal 125 respectively. Lateral gate seal 125 is typical of the lateral gate seals installed at either side of plate 135. Plate 135 is manufactured having a clearance at either side with respect to side structure. For instance in one embodiment, a width of plate 135 is approximately 1.27 centimeters, (½ inch), less than a distance between side structure giving approximately 0.64 centimeters, (¼ inch), clearance on each side to prevent interference with side structure 141 and 142.

Figure 9:
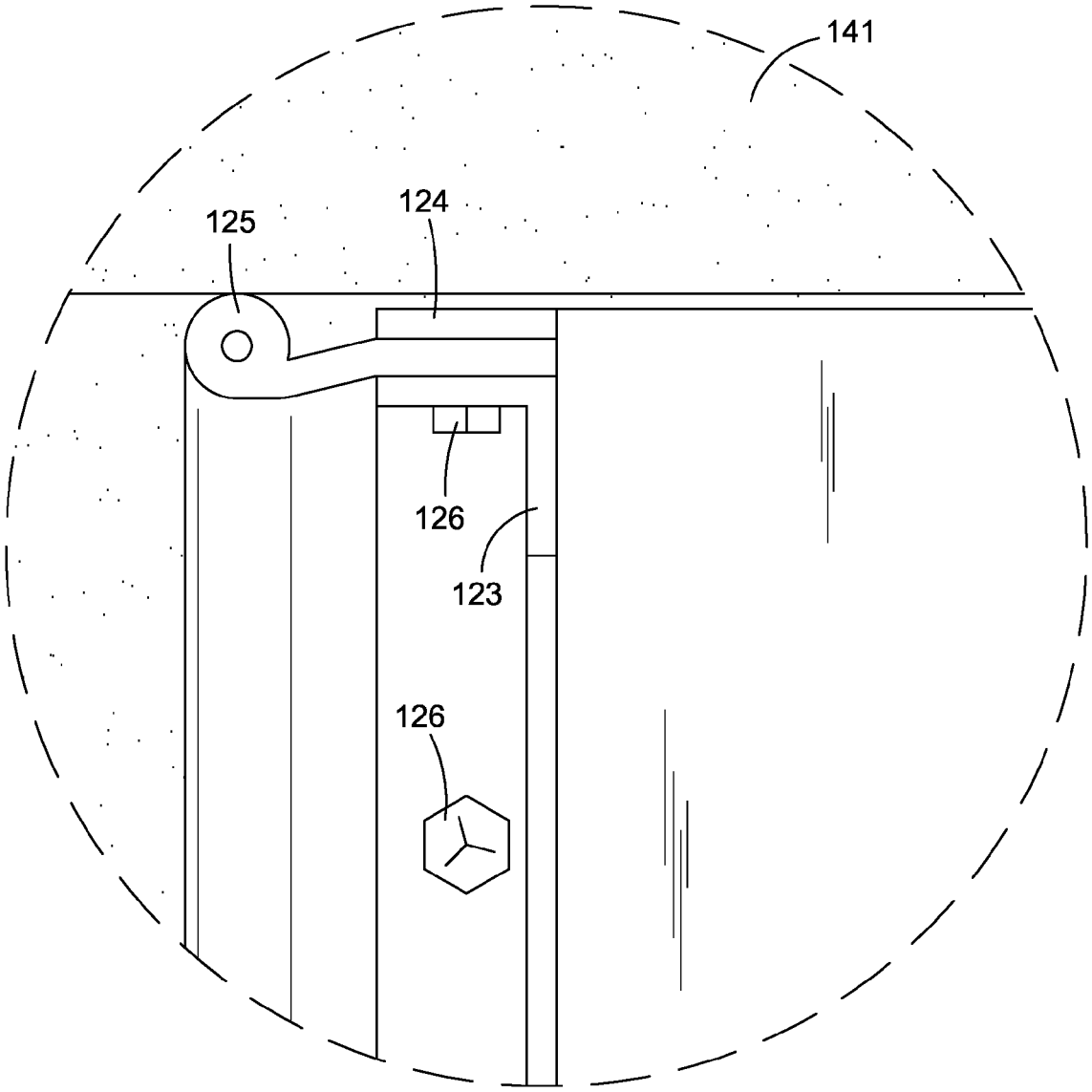
FIG. 9 is a detailed side view of the bottom seal of the automatic trip gate.

FIG. 9 shows details of lateral gate seal 125 comprises solid bulb and tail seal 123, as manufactured by Seals Unlimited of Beaverton, Oreg. Lateral gate seal 125 is typical of the seal fitted to both sides of plate 135. Lateral gate seal 125 is held in position by steel support angle 126 and pinch bar 29. A compressive force is maintained between steel support bar 124 and pinch bar 123 by a plurality of screws 126.

Figure 10:
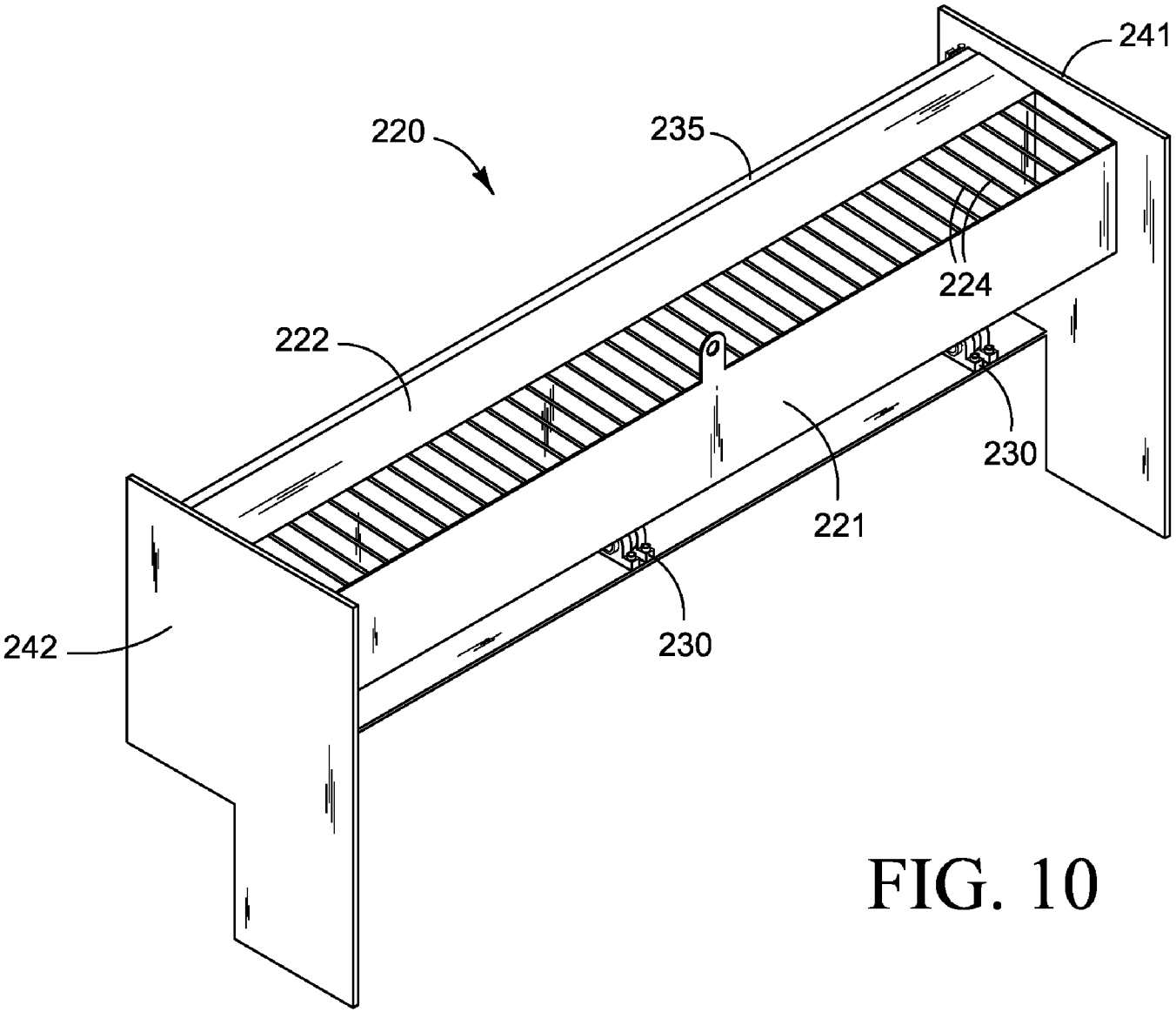
FIG. 10 is an overhead plan view of an automatic trip gate according to the present invention.

FIG. 10 shows automatic trip gate 220 including trough 221 attached to plate 235 by gate top plate 222. Automatic trip gate 220 is fabricated with integrated trip gate support structure, namely side plates 241 and 242. Side plates 241 and 242 not only provide integrated support for hinged support arm assembly 230 and the pivotally attached plate 235 and trough 221, but the side plates 241 and 242 also provide a smooth, flat surface that promotes the life of seals, (not shown in FIG. 10. Side plates 241 and 242 also reduce if not eliminate the incidence of jamming during tipping. The top of trough 221 is covered by trash screen 227. Automatic trip gate 220 is pivotably supported by hinged support arm assembly 230. Hinged support arm assembly 230 is typical of the plurality of hinged support arm assemblies that pivotably support trough 221.

The foregoing description of the illustrated embodiments has been presented for purposes of illustration and description. It is not intended to be exhaustive or to limit the invention to the precise form or to exemplary embodiment(s) and implementation(s) disclosed. Numerous modifications and variations will be apparent to practitioners skilled in this art. Process steps described might be interchangeable with other steps in order to achieve the same result. At least one preferred embodiment was chosen and described in order to best explain the principles of the invention and a best mode of practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, or method step in the present disclosure is intended to be dedicated to the public regardless of whether the element, component, or method step is explicitly recited in the following claims. No claim element herein is to be construed under the provisions of 35 U.S.C. Sec. 112, sixth paragraph unless the element is expressly recited using the phrase "means for . . . ."

We claim:

1. An automatic trip gate for installation in a gate support structure for releasing overflow water from an impounded body of water through the gate support structure, the automatic trip gate comprising:

a hinged support arm assembly including a foot, a first end of the foot adapted to be pivotably attached to the gate support structure at an axis of rotation;

a plate attached to and extending from a second end of the foot of the hinged support arm assembly, the plate attached to the second end of the foot upstream of the axis of rotation, a weight of the plate combined with a length of the attached foot extending between the plate and the axis of rotation providing a moment to resist an opposite hydraulic force of the impounded water;

a trough attached to the plate, the trough positioned downstream from the plate and downstream from the axis of rotation of the hinged support arm assembly, the trough adapted to catch and retain overflow water flowing over the plate; and the foot of the hinged support arm assembly and the attached plate and trough further adapted to pivot at the axis of rotation of the hinged support arm assembly from a substantially vertical orientation wherein the impounded body of water is maintained upstream of the plate, to a tipped position, caused when a weight of the trough and the overflow water retained by the trough reach a tripping level creating an overturning moment, wherein the foot of the hinged support arm assembly and the attached plate and trough tip, and the impounded body of water is released over the tipped plate.

2. The automatic trip gate of claim 1 further comprising means for regulating a level of overflow water retained in the trough.

3. The automatic trip gate of claim 1 further comprising a gate top plate attached near an upper edge of the plate, the gate top plate extending downstream from the plate, the trough attached to the top plate downstream from the plate and downstream from the axis of rotation of the hinged support arm assembly.

4. The automatic trip gate of claim 1 wherein the trough further comprises one or more drains adapted to regulate the rate at which the level of overflow water reaches a tripping level in the trough.

5. The automatic trip gate of claim 1 wherein the hinged support arm assembly further comprises:

a hinge end support adapted to be attached to the gate support structure;

a hinge pin rotatable in the hinge end support; and the first end of the foot connected to the hinge end support by the hinge pin on the axis of rotation.

6. The automatic trip gate of claim 5 wherein the hinged support arm assembly further comprises a bushing disposed between the hinge pin and the hinge end support.

7. The automatic trip gate of claim 1 wherein the plate further comprises a seal attached to an edge of the plate, the seal adapted for sealing engagement between the plate and the gate support structure.

8. An automatic trip gate for installation in a gate support structure for releasing overflow water from an impoundment of water through the gate support structure, the automatic trip gate comprising:

a hinged support arm assembly including a foot, a first end of the foot adapted to be pivotably attached to the gate support structure at an axis of rotation;

a plate attached to and extending from a second end of the foot of the hinged support arm assembly, the plate attached to the second end of the foot upstream of the axis of rotation, a weight of the plate combined with a length of the attached foot extending between the plate and the axis of rotation providing a moment to resist an opposite hydraulic force of the impounded water;

a trough attached to the plate, the trough positioned downstream from the plate and downstream from the axis of rotation of the hinged support arm assembly, the trough adapted to catch and retain overflow water flowing over the plate, the trough including means for regulating a level of overflow water retained in the trough; and the foot of the hinged support arm assembly and the attached plate and trough further adapted to pivot at the axis of rotation of the hinged support arm assembly from a substantially vertical orientation wherein the impounded body of water is maintained upstream of the plate, to a tipped position, caused when a weight of the trough and the overflow water retained by the trough reach a tripping level creating an overturning moment, wherein the foot of the hinged support arm assembly and the attached plate and trough tip, and the impounded body of water is released over the tipped plate.

9. The automatic trip gate of claim 8 wherein the hinged support arm assembly further comprises:

a hinge end support adapted to be attached to the gate support structure;

a pin rotatable in the hinge end support; and the first end of the foot connected to the hinge end support by the pin on the axis of rotation.

10. The automatic trip gate of claim 8 wherein the plate further comprises a seal attached to an edge of the plate, the seal adapted for sealing engagement between the plate and the gate support structure.

11. The automatic trip gate of claim 8 wherein the trough further comprises one or more drain holes adapted to regulate the rate at which the level of overflow water reaches a tripping level in the trough.

12. An automatic trip gate system for installation in a bank of an impounded body of water for controlling a release of an overflow of water from the impounded body of water, the automatic trip gate system comprising:

a spillway including a gate support structure installed in the bank of the impounded body of water;

an automatic trip gate installed in the gate support structure, the automatic trip gate including a hinged support arm assembly including a foot, a first end of the foot pivotably attached to the gate support structure at an axis of rotation, a plate attached to and extending from a second end of the foot of the hinged support arm assembly, a weight of the plate combined with a length of the attached foot extending between the plate and the axis of rotation providing a moment to resist an opposite hydraulic force of the impounded water, a trough attached to the plate, the trough positioned downstream from the plate and downstream from the axis of rotation of the hinged support arm assembly, the trough adapted to catch and retain overflow water flowing over the plate from the impounded body of water, and the foot of the hinged support arm assembly and the attached plate and trough further adapted to pivot at the axis of rotation of the hinged support arm assembly from a substantially vertical orientation wherein the impounded body of water is maintained behind the plate, to a tipped position, caused when a weight of the trough and the overflow water retained by the trough reach a tripping level creating an overturning moment, wherein the foot of the hinged support arm assembly and the attached plate and trough tip, and the impounded body of water is released over the tipped plate.

13. The automatic trip gate system of claim 12 further comprising means for regulating a level of overflow water retained in the trough.

14. The automatic trip gate of claim 12 further comprising a gate top plate attached near an upper edge of the plate, the gate top plate extending downstream from the plate, the trough attached to the top plate downstream from the plate and downstream from the axis of rotation of the hinged support arm assembly.

15. The automatic trip gate of claim 12 wherein the trough further comprises one or more drains adapted to regulate the rate at which the level of overflow water reaches a tripping level in the trough.

16. The automatic trip gate of claim 12 wherein the hinged support arm assembly further comprises:

a hinge end support attached to the gate support structure;

a hinge pin rotatable in the hinge end support; and the first end of the foot connected to the hinge end support by the hinge pin on the axis of rotation.

17. The automatic trip gate of claim 12 wherein the hinged support arm assembly further comprises a bushing disposed between the hinge pin and the hinge end support.

18. The automatic trip gate system of claim 12 further comprising a gate seal attached to an edge of the plate, the gate seal adapted for sealing engagement between the plate and the gate support structure.

19. The automatic trip gate system of claim 18 wherein the gate seal further comprises a solid bulb and tail seal.

20. The automatic trip gate system of claim 12 wherein the spillway further comprises a plunge pool formed below the automatic trip gate, the plunge pool adapted to maintain a plunge water level in the plunge pool such that in the event that the plate pivots to a tipped position, the water contained in the plunge pool acts to absorb energy imparted by the pivoting automatic trip gate.

* * * * *